US008401220B2

(12) United States Patent
Kim et al.

(10) Patent No.: US 8,401,220 B2
(45) Date of Patent: Mar. 19, 2013

(54) PIEZOELECTRIC MICRO SPEAKER WITH CURVED LEAD WIRES AND METHOD OF MANUFACTURING THE SAME

(75) Inventors: Dong-kyun Kim, Suwon-si (KR); Byung-gil Jeong, Anyang-si (KR); Seok-whan Chung, Suwon-si (KR); Jun-sik Hwang, Hwaseong-si (KR)

(73) Assignee: Samsung Electronics Co., Ltd., Suwon-si (KR)

( * ) Notice: Subject to any disclaimer, the term of this patent is extended or adjusted under 35 U.S.C. 154(b) by 380 days.

(21) Appl. No.: 12/751,686

(22) Filed: Mar. 31, 2010

(65) Prior Publication Data

US 2011/0075879 A1 Mar. 31, 2011

(30) Foreign Application Priority Data

Sep. 29, 2009 (KR) ..... 10-2009-0092470

(51) Int. Cl.
*H04R 1/02* (2006.01)

(52) U.S. Cl. ..... 381/398; 381/190; 381/173

(58) Field of Classification Search ..... 381/190, 381/173, 398

See application file for complete search history.

(56) References Cited

U.S. PATENT DOCUMENTS

| | | | | |
|---|---|---|---|---|
| 5,091,958 | A * | 2/1992 | Sakamoto et al. | 381/150 |
| 6,188,775 | B1 * | 2/2001 | Azima et al. | 381/431 |
| 6,597,798 | B1 * | 7/2003 | Nakazono et al. | 381/410 |
| 6,732,832 | B2 * | 5/2004 | Chan | 181/166 |
| 6,978,032 | B2 | 12/2005 | Ogura et al. | |
| 7,369,674 | B2 * | 5/2008 | Miura | 381/401 |
| 8,107,650 | B2 * | 1/2012 | Fujiwara et al. | 381/190 |
| 2004/0001603 | A1 * | 1/2004 | Sahyoun | 381/404 |
| 2004/0022410 | A1 * | 2/2004 | Bohlender | 381/431 |

FOREIGN PATENT DOCUMENTS

| | | | |
|---|---|---|---|
| KR | 20-0335706 | Y1 | 2/2003 |
| KR | 100385388 | B1 | 5/2003 |
| KR | 20-0389003 | Y1 | 7/2005 |

* cited by examiner

*Primary Examiner* — Forrest M Phillips

(74) *Attorney, Agent, or Firm* — Sughrue Mion, PLLC

(57) ABSTRACT

A micro speaker includes a substrate having a cavity formed therein, a diaphragm formed on the substrate overlapping the cavity. The diaphragm includes a first vibration membrane formed in a first area corresponding to a center portion of the cavity and a second vibration membrane formed in a second area corresponding to an edge portion of the cavity and formed of material different from that used for the first vibration membrane. A piezoelectric actuator is formed including a first electrode layer formed on the first vibration membrane, a piezoelectric layer formed on the first electrode layer, and a second electrode layer formed on the piezoelectric layer, and first and second curved lead wires, respectively connected to the first and second electrode layers across the second area, which are symmetrical to the center of the piezoelectric actuator.

12 Claims, 6 Drawing Sheets

PIEZOELECTRIC MICRO SPEAKER WITH CURVED LEAD WIRES AND METHOD OF MANUFACTURING THE SAME

CROSS-REFERENCE TO RELATED APPLICATIONS

This application claims priority from Korean Patent Application No. 10-2009-0092470, filed on Sep. 29, 2009, in the Korean Intellectual Property Office, the disclosures of which are incorporated herein in their entirety by reference.

BACKGROUND OF THE INVENTION

1. Field

The present disclosure relates to a piezoelectric micro speaker, and more particularly, to a piezoelectric micro speaker with curved lead wires, and a method of manufacturing the same.

2. Description of the Related Art

Due to rapid development of terminals for personal voice communications and data communications, amounts of data to be transmitted and received has increased, while the terminals are required to be small and multifunctional.

In response to these trends, research into acoustic devices using micro electro mechanical system (MEMS) technology has been conducted. In particular, MEMS technology and semiconductor technology makes it possible to manufacture microspeakers with small size and low cost according to a package process and to easily integrate microspeakers with peripheral circuits.

Speakers using MEMS technology can be categorized into electrostatic-type speakers, electromagnetic-type speakers, and piezoelectric-type speakers. Piezoelectric micro speakers can be driven at lower voltages than electrostatic-type speakers, and have simpler and slimmer structures than electromagnetic-type speakers.

SUMMARY

Provided is a piezoelectric micro speaker with curved lead wires and a method of manufacturing the same.

Additional aspects will be set forth in part in the description which follows and, in part, will be apparent from the description, or may be learned by practice of the presented embodiments.

According to one or more embodiments, a micro speaker includes a substrate having a cavity formed therein, a diaphragm formed on the substrate overlapping the cavity, the diaphragm including a first vibration membrane disposed in a first area corresponding to a center portion of the cavity and a second vibration membrane disposed in a second area corresponding to an edge portion of the cavity and formed of a material different from a material of the first vibration membrane, a piezoelectric actuator including a first electrode layer formed on the first vibration membrane, a piezoelectric layer formed on the first electrode layer, and a second electrode layer formed on the piezoelectric layer, and first and second lead wires respectively connected to the first and second electrode layers across the second area, wherein the first and second lead wires are curved and are symmetrical with respect to a center of the piezoelectric actuator.

First and second electrode pads may be provided on an upper surface of a second portion of the first vibration membrane located on the substrate and electrically connected to an external power. The first and second electrode pads may be arranged symmetrically with respect to the center of the piezoelectric actuator, the first lead wire may connect the first electrode pad and the first electrode layer across the second area, and the second lead wire may connect the second electrode pad and the second electrode layer across the second area.

The first lead wire may include a first end portion connected to the first electrode pad, a second end portion connected to the first electrode layer, and a curved portion connecting the first end portion and the second end portion. The second lead wire may include a first end portion connected to the second electrode pad, a second end portion connected to the second electrode layer, and a curved portion connecting the first end portion and the second end portion.

A first imaginary straight line may connect the first end portion of the first lead wire and the first end portion of the second lead wire; a second imaginary straight line may connect the second end portion of the first lead wire and the second end portion of the second lead wire, wherein the first imaginary straight line and the second imaginary straight line cross at a center of the piezoelectric actuator and form an angle $\theta_1$.

A ratio of a diameter of the first portion of the first vibration membrane to a diameter of the cavity may be 70% to 90%, and the angle $\theta_1$ may be between about 5° to 50°.

The ratio of the diameter of the first portion of the first vibration membrane to the diameter of the cavity may be 70% to 80%, and the angle $\theta_1$ may be between about 20° to 50°.

The first end portion of the first lead wire and the first end portion of the second lead wire may extend in a straight line along the first imaginary straight line, and the second end portion of the first lead wire and the second end portion of the second lead wire may extend in a straight line along the second imaginary straight line.

The first end portions of the first and second lead wires may protrude a distance $L_b$ into the second area; the second end portions of the first and second lead wires may protrude a distance $L_a$ into the second area; and a width of each of the first and second lead wires may be W, where $L_b$ is between about 1W and 1.5W and $L_a$ is between about 1W and 1.5W.

The first vibration membrane may include support portions supporting the first and second lead wires and disposed in the second area, wherein the support portions may have the same shape as that of the first and second lead wires.

An elastic coefficient of a material of the second vibration membrane may be lower than an elastic coefficient of a material of the first vibration membrane.

The second vibration diaphragm may be formed of a polymer thin film.

The first vibration membrane may include a first portion disposed in the first area and a second portion disposed on the substrate, and the second vibration membrane may be disposed in the second area, on at least an edge portion of an upper surface of the piezoelectric actuator, and on an upper surface of the second portion of the first vibration membrane.

According to one or more embodiments, a method of manufacturing a micro speaker includes forming a first vibration membrane on a first surface of a substrate, forming a piezoelectric actuator by forming a first electrode layer on the first vibration membrane, forming a piezoelectric layer on the first electrode layer, and forming a second electrode layer on the piezoelectric layer, forming a trench in the first vibration membrane by etching the first vibration membrane, forming a second vibration membrane in the trench, wherein a material of the second vibration membrane is different from that of the first vibration membrane, and forming a cavity which penetrates the substrate by etching a second surface of the substrate, opposite the first surface, until the first and second vibration membranes are exposed, wherein the first vibration membrane comprises a first portion, inside the trench, which is disposed in a first area corresponding to a center portion of the cavity and the second vibration membrane is disposed in a second area corresponding to an edge portion of the cavity. The forming the piezoelectric actuator further comprises forming a first lead wire connected to the first electrode layer across the second area and forming a second lead wire connected to the second electrode layer across the second area, wherein the first lead wire and the second lead wire are curved and are symmetrical with respect to the center of the piezoelectric actuator.

In the forming of a piezoelectric actuator, a first electrode pad, connected to the first lead wire, and a second electrode pad connected to the second lead wire may be formed, and the first electrode pad and the second electrode pad may be symmetrical with respect to the center of the piezoelectric actuator.

The first lead wire may include a first end portion connected to the first electrode pad, a second end portion connected to the first electrode layer, and a curved portion connecting the first end portion and the second end portion. The second lead wire may include a first end portion connected to the second electrode pad, a second end portion connected to the second electrode layer, and a curved portion connecting the first end portion and the second end portion.

A first imaginary straight line may connect the first end portion of the first lead wire and the first end portion of the second lead wire, a second imaginary straight line may connect the second end portion of the first lead wire and the second end portion of the second lead wire, and the first imaginary straight line and the second imaginary straight line may cross at the center of the piezoelectric actuator and form an angle θ1 with each other.

A ratio of a diameter of the first portion of the first vibration membrane to a diameter of the cavity may be 70% to 80%, and the angle $\theta_1$ may be between about 20° to 50°.

The first end portions of the first and second lead wires may extend in a straight line along the first imaginary straight line, and the second end portions of the first and second lead wires may extend in a straight line along the second imaginary straight line.

An elastic coefficient of the second vibration membrane may be lower than an elastic coefficient of the first vibration membrane.

The second vibration membrane may be disposed in the second area, on at least an edge portion of the upper surface of the piezoelectric actuator, and on an upper surface of the second portion of the first vibration membrane.

BRIEF DESCRIPTION OF THE DRAWINGS

These and/or other aspects will become apparent and more readily appreciated from the following description of embodiments, taken in conjunction with the accompanying drawings of which.

DETAILED DESCRIPTION

Figure 1:
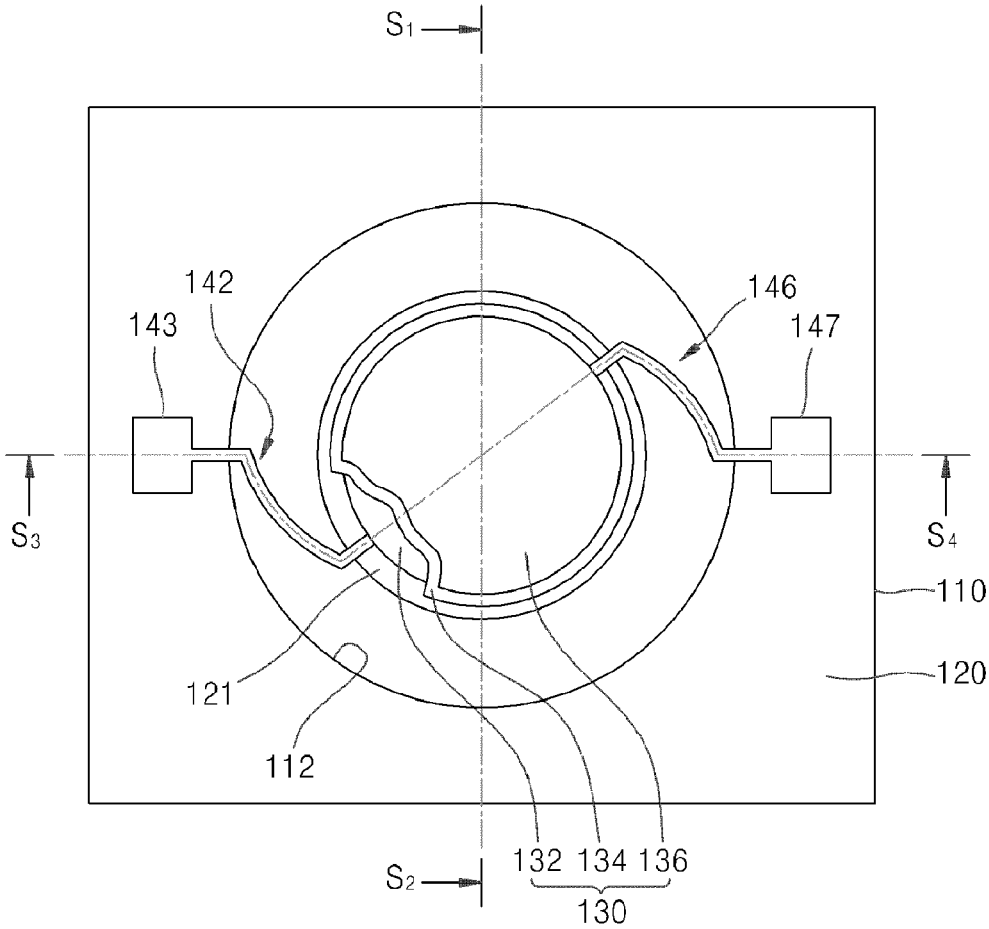
FIG. 1 is a plan view illustrating a piezoelectric micro speaker according to an embodiment in which a second vibration membrane is not illustrated.

Reference will now be made in detail to embodiments, examples of which are illustrated in the accompanying drawings, wherein like reference numerals refer to the like elements throughout. In this regard, the present embodiments may have different forms and should not be construed as being limited to the descriptions set forth herein. Accordingly, the embodiments are merely described below, by referring to the figures, to explain aspects of the present description.

Figure 2A:
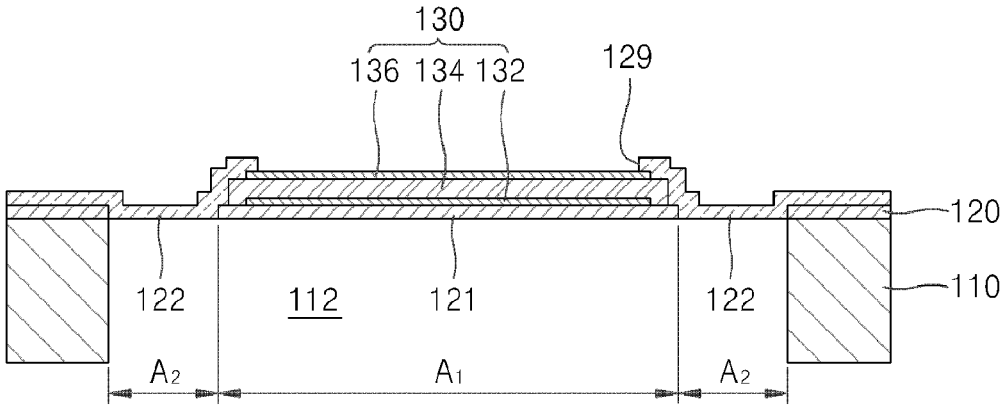
FIG. 2A is a cross-sectional view of the piezoelectric micro speaker taken along the line S1-S2 in FIG. 1.
Figure 2B:
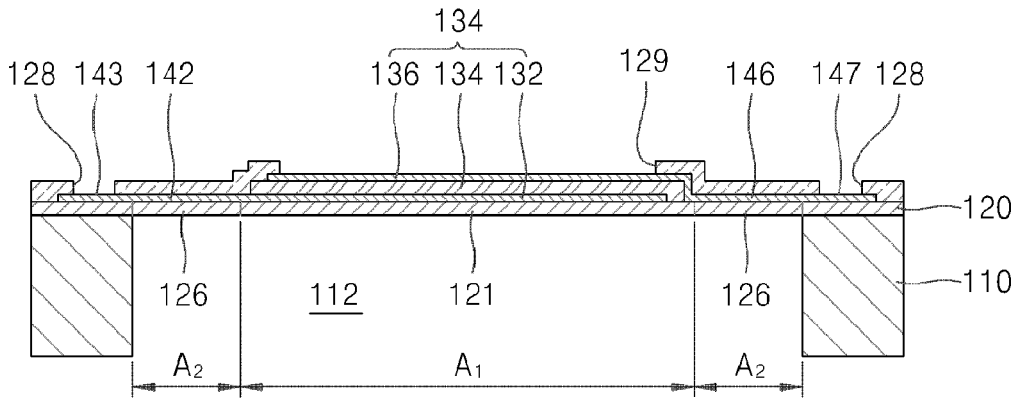
FIG. 2B is a cross-sectional view of the piezoelectric micro speaker taken along the line S3-S4 in FIG. 1.

FIG. 1 is a plan view illustrating a piezoelectric micro speaker according to an embodiment in which a second vibration membrane is not illustrated. FIG. 2A is a cross-sectional view of the piezoelectric micro speaker taken along the lines S1-S2 in FIG. 1. FIG. 2B is a cross-sectional view of the piezoelectric micro speaker taken along the lines S3-S4 in FIG. 1.

Referring to FIGS. 1, 2A, and 2B together, a piezoelectric micro speaker according to the present embodiment includes a substrate 110 having a cavity 112, and a diaphragm 120 formed on the substrate 110 to cover the cavity 112. The diaphragm 120 includes first and second vibration membranes 121 and 122, and a piezoelectric actuator 130 is formed on the first vibration membrane 121. In detail, a silicon wafer that is easy to be finely processed may be used as the substrate 110. The cavity 112 may be formed in a predetermined area of the substrate 110 by penetrating the substrate 110 in the thickness direction thereof, for example, in a cylindrical shape.

The diaphragm 120 may be formed on a surface of the substrate 110 to have a predetermined thickness. The diaphragm 120 includes first and second vibration membranes 121 and 122 formed in an area corresponding to the cavity 112. The first vibration membrane 121 includes a first portion formed in a first area $A_1$ located over the center portion of the cavity 112, and a second portion formed on the surface of the substrate 110. The second vibration membrane 122 is formed in a second area $A_2$ located at the outer circumferential portion of the cavity 112. That is, the second vibration membrane 122 substantially radially surrounds the first portion of the first vibration membrane 121. The second vibration membrane 122 is arranged between the second portion of the first vibration membrane 121 and the first portion of the first vibration membrane 121, to connect the second portion of the first vibration membrane 121 and the first portion of the first vibration membrane 121, thereby supporting the first vibration membrane 121 and the piezoelectric actuator 130 formed thereon against the substrate 110.

Figure 5A:
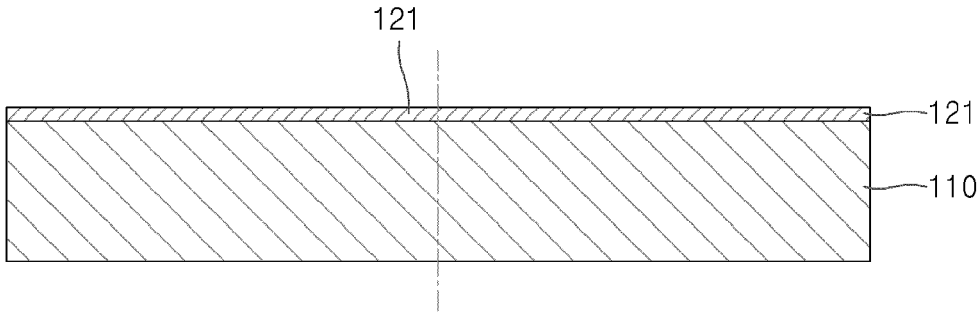
FIGS. 5A-5E are cross-sectional views for explaining a method of manufacturing the piezoelectric micro speaker of FIG. 1.
Figure 5B:
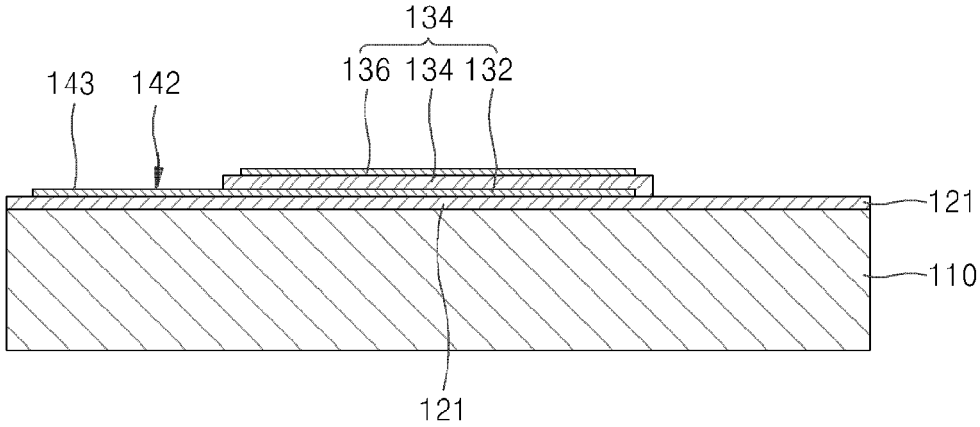
Figure 5C:
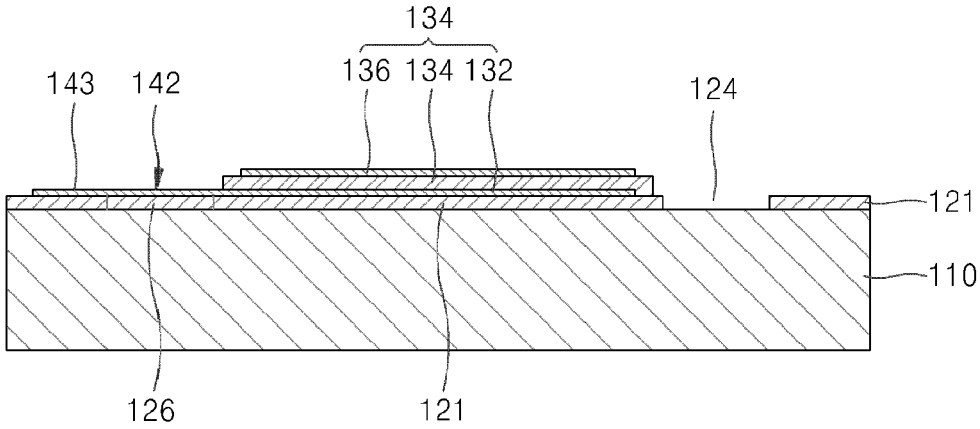
Figure 5D:
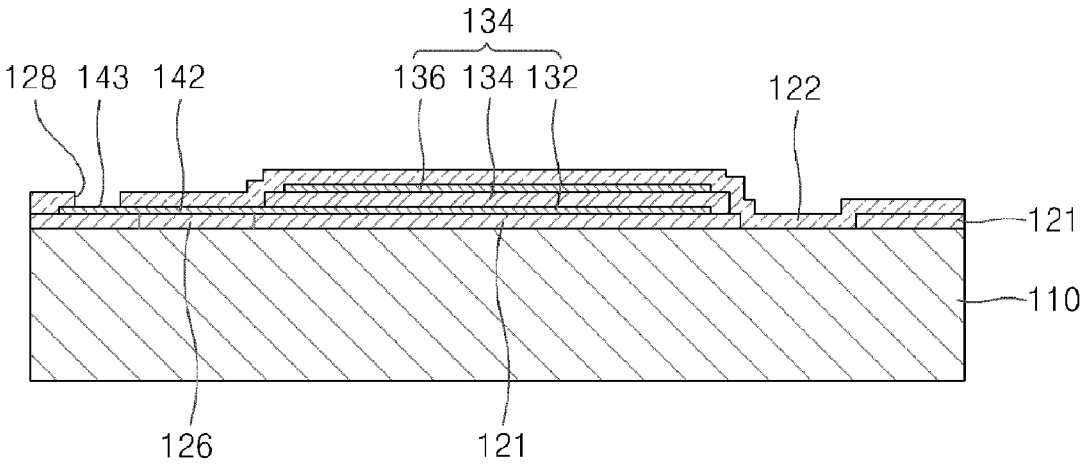

The second vibration membrane 122 may extend not only to the second area $A_2$ but also to the upper surface of the piezoelectric actuator 130 in the first area $A_1$ (inside the second area $A_2$) and to the upper surface of the second portion of the first vibration membrane 121, outside the second area $A_2$. In this case, one or more first apertures 128 expose a first electrode pad 143 and a second electrode pad 147, which are described later, to the outside. The second vibration membrane 122 may cover the upper surface of the piezoelectric actuator 130, or may cover only the edge portion of the upper surface of the piezoelectric actuator 130. To this end, a second aperture 129 to expose the upper surface of the second electrode layer 136 may be formed in the second vibration membrane 122. As illustrated in FIG. 5D, the second vibration membrane 122 may cover the entire upper surface of the piezoelectric actuator 130, thus covering the entire upper surface of the second electrode layer 136.

The first and second vibration membranes 121 and 122 may be formed of different materials. The second vibration membrane 122 may be formed of a soft material having a low elastic coefficient so as to be easily deformed compared to the first vibration membrane 121. The first vibration membrane 121 may be formed of material having an elastic coefficient of about 50 GPa to 500 GPa, for example, silicon nitride, while the second vibration membrane 122 may be formed of material having an elastic coefficient of about 100 MPa to 5 GPa, for example, a polymer thin film.

The piezoelectric actuator 130 may include a first electrode layer 132 disposed on the first portion of the first vibration membrane 121, a piezoelectric layer 134 disposed on the first electrode layer 132, and the second electrode layer 136 disposed on the piezoelectric layer 134. The first and second electrode layers 132 and 136 may be formed of a conductive metal material. The piezoelectric layer 134 may be formed of a piezoelectric material such as AlN, ZnO, or PZT.

The first and second electrode pads 143 and 147 are electrically connected to an external power and are provided on the upper surface of the second portion of the first vibration membrane 121 located on the substrate 110. The first and second electrode pads 143 and 147 are arranged to be symmetrical with respect to the centers of the piezoelectric actuator 130 and the first vibration membrane 121. A first lead wire 142 is connected to the first electrode layer 132 of the piezoelectric actuator 130, while a second lead wire 146 is connected to the second electrode layer 136. That is, the first lead wire 142 connects the first electrode pad 143 and the first electrode layer 132 across the second area $A_2$, while the second lead wire 146 connects the second electrode pad 147 and the second electrode layer 136 across the second area $A_2$. The first and second lead wires 142 and 146 may be arranged at opposite sides so as to be symmetrical with respect to the centers of the piezoelectric actuator 130 and the first vibration membrane 121. The first and second lead wires 142 and 146 are formed to be curved, which will be described later in detail with reference to FIG. 3.

The first vibration membrane 121 may include a support portion 126 formed in the second area $A_2$ and supporting the first and second lead wires 142 and 146 may be. The support portion 126 may be formed of the same material as that of the first and second portions of the first vibration membrane 121 and may connect the first portion of the first vibration membrane 121 to the second portion of the first vibration membrane 121. As described above, although the second vibration membrane 122 connects the second portion of the first vibration membrane 121 and the first portion of the first vibration membrane 121, the support portion 126 may be disposed such that it only connects the second portion of the first vibration membrane 121 and the first portion of the first vibration membrane 121 in a region where the first and second lead wires 142 and 146 are disposed. The support portion 126 may have the same shape as that of the first and second lead wires 142 and 146.

Figure 3:
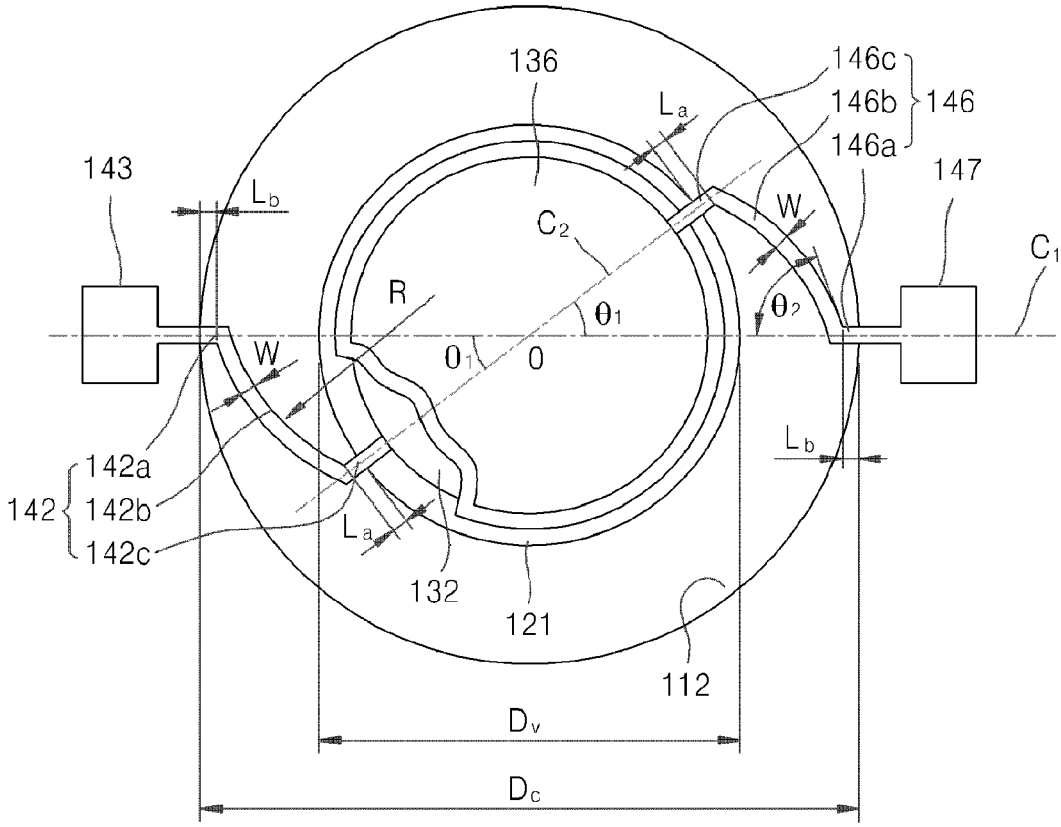
FIG. 3 is a plan view illustrating the shapes of the lead wires of FIG. 1 by magnifying the same.

FIG. 3 is a plan view illustrating the shapes of the lead wires of FIG. 1 by magnifying the same. Referring to FIG. 3, the first and second lead wires 142 and 146 are formed to be curved at the opposite sides of the piezoelectric actuator 130 and symmetrical with respect to a center O of the piezoelectric actuator 130. In detail, the first lead wire 142 may include a first end portion 142*a* connected to the first electrode pad 143, a second end portion 142*c* connected to the first electrode layer 132, and a curved portion 142*b* connecting between the first and second end portions 142*a* and 142*c*. Likewise, the second lead wire 146 may include a first end portion 146*a* connected to the second electrode pad 147, a second end portion 146*c* connected to the second electrode layer 136, and a curved portion 146*b* connecting between the first and second end portions 146*a* and 146*c*. The curved portions 142*b* and 146*b* are arranged in the second area $A_2$ and have a predetermined radius of curvature R.

The first end portions 142*a* and 146*a* are respectively connected to the first and second electrode pads 143 and 147 and may be arranged on a straight line $C_1$ that passes the center O and the first and second electrode pads 143 and 147. The second end portions 142*c* and 146*c* are respectively connected to outer circumferential portions of the first and second electrode layers 132 and 136 and may be arranged on a straight line $C_2$ that passes through the center O and is inclined by a predetermined angle $\theta_1$ with respect to the straight line $C_1$. That is, the first end portion 142*a* and 146*a* and the center O are disposed along a first line $C_1$, the second end portions 142*c* and 146*c* are disposed along a second line $C_2$, and the first line $C_1$ and the second line $C_2$ cross at the center O of the piezoelectric actuator 130 and the first vibration membrane 121 and form an angle $\theta_1$ with each other. Accordingly, the curved portions 142*b* and 146*b* connecting the first end portions 142*a* and 146*a* and the second end portions 142*c* and 146*c* have lengths extending through the angle $\theta_1$. The radius of curvature R of the curved portions 142*b* and 146*b* may be greater than the radius of the first vibration membrane 121 and may vary according to the angle $\theta_1$. An angle $\theta_2$ is an angle between a tangent of the curved portions 142*b* and 146*b* at the end portions 142*a* and 146*a* with respect to the straight line $C_1$. The angle $\theta_2$ may vary according to the angle $\theta_1$. That is, as the angle $\theta_1$ increases, the angle $\theta_2$ increases accordingly.

The first end portions 142*a* and 146*a* and the second end portions 142*c* and 146*c* may be linear. This reduces the structural strength of the first vibration membrane 121 by decreasing the contact area between the first end portions 142*a* and 146*a* and the first and second electrode pads 143 and 147 and the contact area between the second end portions 142*c* and 146*c* and the first vibration membrane 121. In detail, the first end portions 142*a* and 146*a* may linearly extend along the straight line $C_1$ from each of the first and second electrode pads 143 and 147 to the second area $A_2$. That is, the first end portions 142*a* and 146*a* extend in a radial direction with respect to the cavity 112. The second end portions 142*c* and 146*c* may linearly extend along the straight line $C_2$ from each of the first and second electrode layers 132 and 136 to the second area $A_2$. That is, the second end portions 142*c* and 146*c* extend in a radial direction with respect to the outer circumference of the first vibration membrane 121. The first end portions 142*a* and 146*a* may have a length which extends a distance of $L_b$ inside the second area $A_2$. The second end portions 142*c* and 146*c* may have a length which extends a distance of $L_a$ inside the second area $A_2$. The width W of the first and second lead wires 142 and 146 may be about 30-70 μm. The lengths $L_b$ and $L_a$ of the first end portions 142*a* and 146*a* and the second end portions 142*c* and 146*c* protruding inside of the second area $A_2$ may be 1-1.5 times the width W.

If the first and second lead wires 142 and 146 were to extend straight along the straight line $C_1$ without any curved portion, the structural strength would increase relatively large enough to hinder vibrations of the first and second vibration membranes 121 and 122. That is, though the second vibration membrane 122 formed of a soft material is formed in the second area $A_2$, if the first and second lead wires 142 and 146 were straight lines crossing the second area $A_2$, they might hinder the vibrations of the first and second vibration membranes 121 and 122.

However, as illustrated in FIG. 3, when the first and second lead wires 142 and 146 are curved by extending through the angle $\theta_1$ in the second area $A_2$, the structural strength may be substantially reduced as low as that of a case in which there is no lead wire.

Figure 4A:
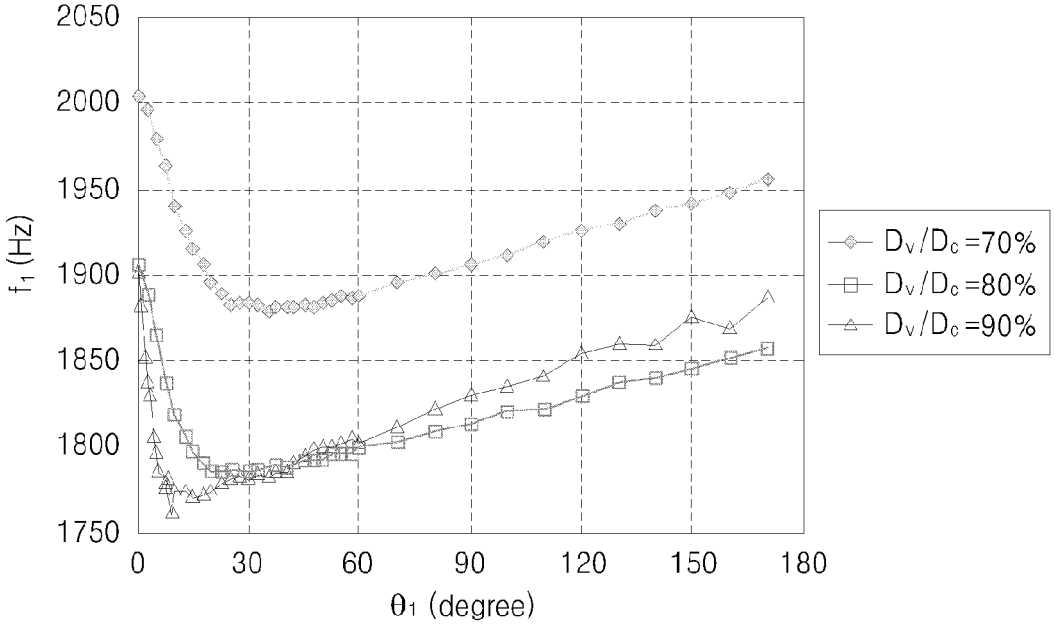
FIG. 4A is a graph showing a result of simulation of a change in the minimum acoustic resonance frequency f1 according to the angle θ1 of FIG. 3, in the piezoelectric micro speaker of FIG. 1.

FIG. 4A is a graph showing a result of simulation of a change in the minimum acoustic resonance frequency $f_1$ according to the angle $\theta_1$ of FIG. 3, in the piezoelectric micro speaker of FIG. 1. Referring to FIG. 4A, compared to a case in which the lead wires 142 and 146 are formed to be entirely linear (the angle $\theta_1$ is 0° it can be seen that the minimum resonance frequency $f_1$ decreases when the lead wires 142 and 146 are formed to be curved (the angle $\theta_1$ is greater than)0°. In detail, when a ratio $D_V/D_C$ of the diameter $D_V$ of the portion of the first vibration membrane 121 disposed over the cavity to the diameter $D_C$ of the cavity 112 is 70%, the minimum resonance frequency $f_1$ is the lowest in a range in which the angle $\theta_1$ is about 25° to 50°. When $D_V/D_C$ is 80%, the minimum resonance frequency $f_1$ appears in a range in which the angle $\theta_1$ is about 20° to 40°. When $D_V/D_C$ is 90%, the minimum resonance frequency $f_1$ is the lowest in a range in which the angle $\theta_1$ is about 5°-20°.

Figure 4B:
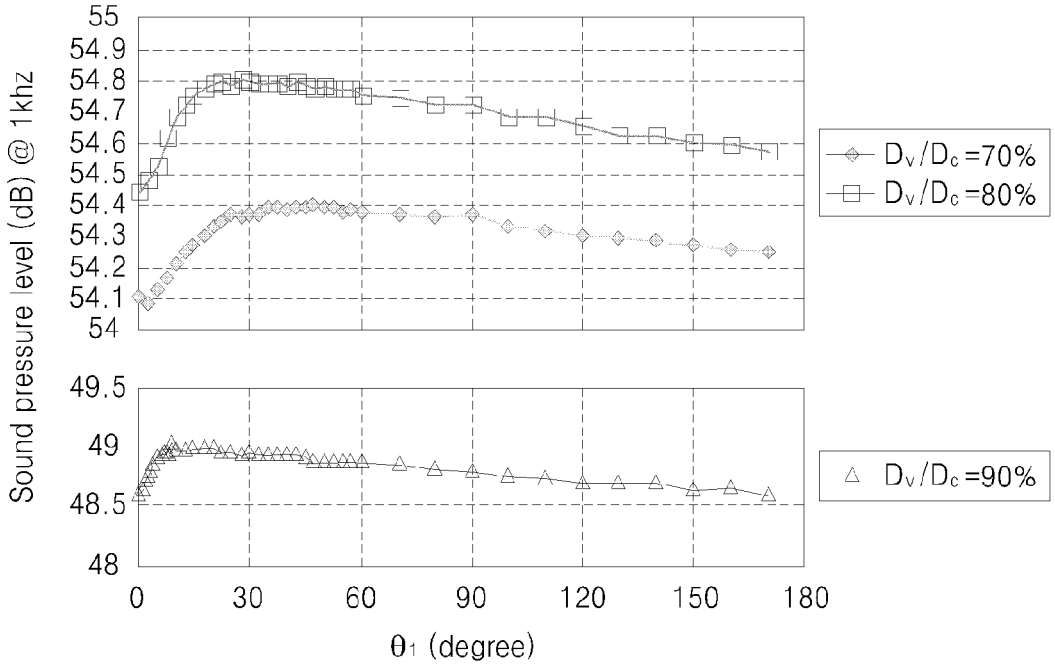
FIG. 4B is a graph showing a result of simulation of a change in the output sound pressure level at the frequency of 1 kHz according to the angle θ1 of FIG. 3, in the piezoelectric micro speaker of FIG. 1.

FIG. 4B is a graph showing a result of simulation of a change in the output sound pressure level at the frequency of 1 kHz according to the angle $\theta_1$ of FIG. 3, in the piezoelectric micro speaker of FIG. 1. Referring to FIG. 4B, compared to a case in which the lead wires 142 and 146 are formed to be entirely linear (the angle $\theta_1$ is 0° it can be seen that the output sound pressure level at the frequency of 1 kHz increases when the lead wires 142 and 146 are formed to be curved (the angle $\theta_1$ is greater than)0°. In detail, when the ratio $D_V/D_C$ of the diameter $D_V$ of the portion of the first vibration membrane 121 disposed over the cavity to the diameter $D_C$ of the cavity 112 is 70%, the highest output sound pressure level at the frequency of 1 kHz appears in a range in which the angle $\theta_1$ is about 30° to 60°. When $D_V/D_C$ is 80%, the highest output sound pressure level at the frequency of 1 kHz appears in a range in which the angle $\theta_1$ is about 20° to 50°. When $D_V/D_C$ is 90%, the highest output sound pressure level at the frequency of 1 kHz appears in a range in which the angle $\theta_1$ is about 5° to 20°.

When $D_V/D_C$ is 80%, the average output sound pressure level at the frequency of 1 kHz is relatively high. When $D_V/D_C$ is 90%, the average output sound pressure level at the frequency of 1 kHz is relatively low.

Figure 4C:
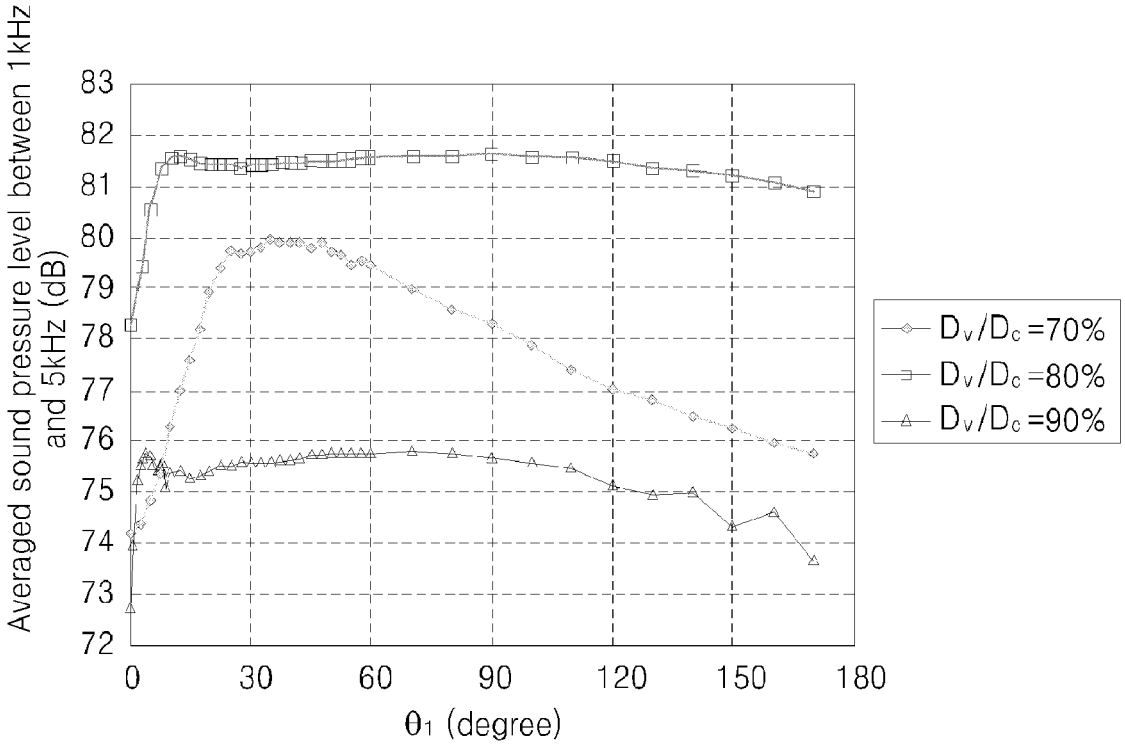
FIG. 4C is a graph showing a result of simulation of a change in the average output sound pressure level at a frequency between 1 kHz to 5 kHz according to the angle θ1 of FIG. 3, in the piezoelectric micro speaker of FIG. 1.

FIG. 4C is a graph showing a result of simulation of a change in the average output sound pressure level at a frequency between 1 kHz to 5 kHz according to the angle $\theta_1$ of FIG. 3, in the piezoelectric micro speaker of FIG. 1. Referring to FIG. 4C, compared to a case in which the lead wires 142 and 146 are formed to be linear (the angle $\theta_1$ is 0° it can be seen that the average output sound pressure level at a frequency between 1 kHz to 5 kHz increases when the lead wires 142 and 146 are formed to be curved (the angle $\theta_1$ is greater than 0°. In detail, when the ratio $D_V/D_C$ of the diameter $D_V$ of the portion of the first vibration membrane 121 disposed over the cavity to the diameter $D_C$ of the cavity 112 is 70%, the highest average output sound pressure level at a frequency between 1 kHz to 5 kHz appears in a range in which the angle $\theta_1$ is about 30°-50°. When $D_V/D_C$ is 80%, the highest average output sound pressure level at a frequency between 1 kHz to 5 kHz appears in a range in which the angle $\theta_1$ is not less than about 10°. When $D_V/D_C$ is 90%, the highest average output sound pressure level at a frequency between 1 kHz to 5 kHz appears in a range in which the angle $\theta_1$ is not less than about 5°.

When $D_V/D_C$ is 80%, the average output sound pressure level at a frequency between 1 kHz to 5 kHz is relatively high. When $D_V/D_C$ is 90%, the average output sound pressure level at a frequency between 1 kHz to 5 kHz is relatively low.

According to the above simulation results, when $D_V/D_C$ is 70% to 90%, in a range in which the angle $\theta_1$ is about 5° to 50°, it can be seen that the minimum resonance frequency $f_1$ decreases, the output sound pressure level at the frequency of 1 kHz increases, and the average output sound pressure level at a frequency between 1 kHz to 5 kHz increases. Also, it can be seen that the output sound pressure level is relatively high when $D_V/D_C$ is 70% to 80%, compared to a case in which $D_V/D_C$ is 90%.

Thus, when $D_V/D_C$ is 70% to 80% and the angle $\theta_1$ is about 20° to 50°, the minimum resonance frequency $f_1$ and the output sound pressure level are more effective.

As described above, in the embodiments of FIGS. 1-3, since the second vibration membrane 122 formed of a soft material having a relatively low elastic coefficient is arranged in the second area $A_2$ located at the edge portion of the cavity 112, the overall structural strength of the diaphragm 120 is lowered and thus the amount of deformation may be increased. Accordingly, the sound output may be improved.

Also, since the first and second lead wires 142 and 146 formed in the second area $A_2$ are formed to be curved, the structural strength is further lowered and thus a resonance frequency decreases. Accordingly, the output sound pressure level in the low frequency band may be improved and the average output sound pressure level at a frequency between 1 kHz to 5 kHz may be improved.

A method of manufacturing a piezoelectric micro speaker configured as above will be described below with reference to FIGS. 5A-5C. FIGS. 5A-5C are cross-sectional views for explaining a method of manufacturing the piezoelectric micro speaker of FIG. 1.

First, referring to FIG. 5A, the substrate 110 is prepared and a silicon wafer that is easy to be finely processed may be used therefor. The diaphragm 120 is formed on a surface of the substrate 110 to have a predetermined thickness. In detail, the first vibration membrane 121 may be formed by depositing an insulation material such as silicon nitride $Si_xN_y$, for example, $Si_3N_4$, on a surface of the substrate 110 with a thickness of 0.5 μm-3 μm by using a chemical vapor deposition (CVD) process. A portion of the first vibration membrane 121 formed in the first area $A_1$, located at the center portion of the cavity 112, functions as the portion of the first vibration membrane 121 which will be disposed over the cavity 112.

Next, as illustrated in FIG. 5B, the piezoelectric actuator 130 is formed on the first vibration membrane 121 of the diaphragm 120. The piezoelectric element 130 may be formed by depositing the first electrode layer 132 on the first vibration membrane, depositing the piezoelectric layer 134 on the first electrode layer, and depositing the second electrode layer 136 on the piezoelectric layer 134. In detail, the first electrode layer 132 may be formed by depositing conductive metal material, for example, Cr, Au, Mo, Cu, Al, Ti, or Pt, on the first vibration membrane 121 with a thickness of 0.1 μm-3 μm by using a sputtering or evaporation method, and then etching the same to be patterned into a predetermined shape. The first electrode layer 132 may be formed into a metal film of a single layer or multiple layers. The piezoelectric layer 134 may be formed by depositing piezoelectric material, for example, AlN, ZnO, PZT, $PbTiO_3$, or PLT, on the first electrode layer 134 with a thickness of 0.1 μm-3 μm by using a sputtering or spin-coating method. The piezoelectric layer 134 may be formed to be slightly larger than the first electrode layer 132 enough to cover the first electrode layer 132 so as to insulate the first electrode layer 132 from the second electrode layer 136. The second electrode layer 136 may be formed on the piezoelectric layer 134 in the same method as that used to form the first electrode layer 132.

Simultaneously with the formation of the first electrode layer 132, the first lead wire 142 connected to the first electrode layer 132 and the first electrode pad 143 connected to the end portion of the first lead wire 142 may be formed on the first vibration membrane 121. Also, simultaneously with the formation of the second electrode layer 136, the second lead wire 146 connected to the second electrode layer 136 and the second electrode pad 147 connected to the end portion of the second lead wire 146 may be formed on the first vibration membrane 121. The first and second lead wires 142 and 146 and the first and second electrode pads 143 and 147 may be formed by using the same material and method as those used for the first and second electrode layers 132 and 136. The first and second lead wires 142 and 146 are patterned to have the shape of FIG. 3.

Next, as illustrated in FIG. 5C, a trench 124 is formed in the second area $A_2$ located at the edge portion of the cavity 112 that is to be formed later in the operation of FIG. 5E, by etching the first vibration membrane 121. Then, the portion of the first vibration membrane 121 surrounded by the trench 124 is defined in the first area $A_1$ located at the center portion of the cavity 112. In the area of the second area $A_2$ where the first and second lead wires 142 and 146 are formed, the trench 124 is not be formed and the support portion 126 supporting the first and second lead wires 142 and 146 may remain instead. The support portion 126 remains directly under the first and second lead wires 142 and 146 and may have the same shape as that of the first and second lead wires 142 and 146.

Next, referring to FIG. 5D, the second vibration membrane 122 formed of material different from that used for the first vibration membrane 121 is formed in the trench 124. The second vibration membrane 122 may be formed of soft material having a low elastic coefficient, for example, a polymer thin film, so as to be easily deformed compared to the first vibration membrane 121. In detail, the first vibration membrane 121 may be formed of silicon nitride as described above, while the second vibration membrane 122 may be formed of parylene that is deposited with a thickness of, for example, 0.5 μm-10 μm.

The second vibration membrane 122 may extend not only to the second area $A_2$ but to the overall upper surface of the piezoelectric actuator 130 in the area $A_1$ (inside the second area $A_2$) and an upper surface of a second portion of the first vibration membrane 121 on the substrate 110 outside the second area $A_2$. The first aperture 128 to expose the first and second electrode pads 143 and 147 to the outside may be formed in the second vibration membrane 122 by partially etching the second vibration membrane 122 by using $O_2$ plasma. As illustrated in FIG. 2A, the second vibration membrane 122 may be formed to cover only the edge portion of the upper surface of the piezoelectric actuator 130. In this case, simultaneously with the formation of the first aperture 128, the second aperture 129 to expose the upper surface of the piezoelectric actuator 130, except for the edge portion thereof, may be formed in the second vibration membrane 122.

Figure 5E:
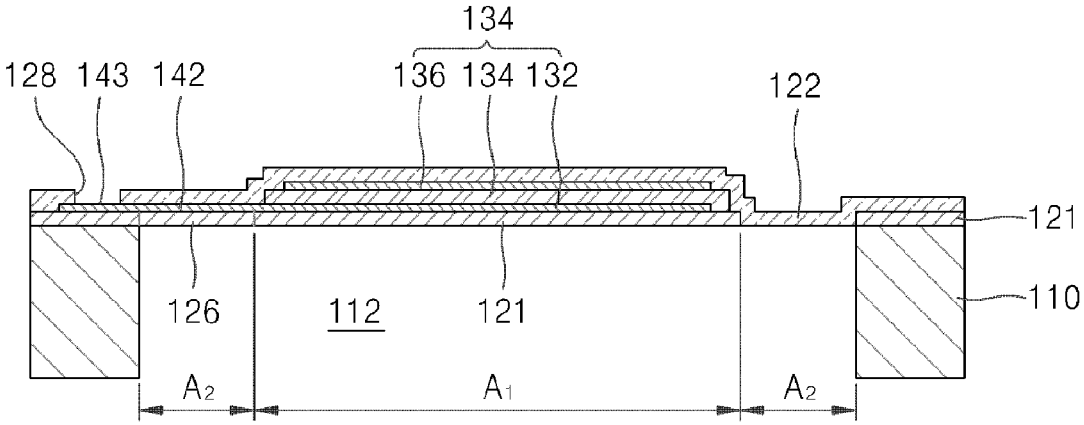

Next, as illustrated in FIG. 5E, the other surface of the substrate 110 is etched until the first and second vibration membranes 121 and 122 are exposed, thereby forming the cavity 112 penetrating the substrate 110 in the thickness direction thereof.

Accordingly, the first vibration membrane 121 is formed in the first area $A_1$ located at the center portion of the cavity 112. Also, a piezoelectric micro speaker having a structure is completed, in which the second vibration membrane 122 formed of the soft material and the first and second lead wires 142 and 146 that are curved are formed in the second area $A_2$ located at the edge portion of the cavity 112.

It should be understood that the embodiments described herein should be considered in a descriptive sense only and not for purposes of limitation. Descriptions of features or aspects within each embodiment should typically be considered as available for other similar features or aspects in other embodiments.

What is claimed is:

1. A micro speaker comprising:

a substrate having a cavity formed therein;

a diaphragm that is disposed on the substrate and overlaps the cavity, the diaphragm comprising:

a first vibration membrane disposed in a first area corresponding to a center portion of the cavity; and a second vibration membrane disposed in a second area corresponding to an edge portion of the cavity, wherein a material of the second vibration membrane is different from a material of the first vibration membrane, and the second area surrounds the first area;

a piezoelectric actuator comprising a first electrode layer disposed on the first vibration membrane, a piezoelectric layer disposed on the first electrode layer, and a second electrode layer disposed on the piezoelectric layer;

a first lead wire that is disposed in the second area and is connected to the first electrode layer; and a second lead wire that is disposed in the second area and is connected to the second electrode layer, wherein the first and second lead wires are curved and are symmetrically disposed with respect to a center of the piezoelectric actuator.

2. The micro speaker of claim 1, wherein the first vibration membrane comprises a first portion disposed in the first area and a second portion disposed on the substrate, and the micro speaker further comprising:

a first electrode pad which is disposed on an upper surface the second portion of the first vibration membrane and which is electrically connected to an external power, wherein the first lead wire connects the first electrode pad and the first electrode layer across the second area, and a second electrode pad which is disposed on an upper surface of the second portion of the first vibration membrane and which is electrically connected to the external power, wherein the second lead wire connects the second electrode pad and the second electrode layer across the second area.

3. The micro speaker of claim 2, wherein:

the first lead wire comprises a first end portion connected to the first electrode pad, a second end portion connected to the first electrode layer, and a curved portion connecting the first end portion and the second end portion; and the second lead wire comprises a first end portion connected to the second electrode pad, a second end portion connected to the second electrode layer, and a curved portion connecting the first end portion and the second end portion.

4. The micro speaker of claim 3, wherein:

a first imaginary straight line connects the first end portion of the first lead wire and the first end portion of the second lead wire;

a second imaginary straight line connects the second end portion of the first lead wire and the second end portion of the second lead wire; and the first imaginary straight line and the second imaginary straight line cross at a center of the piezoelectric actuator and form an angle θ1 with respect to each other.

5. The micro speaker of claim 4, wherein a ratio of a diameter of the first portion of the first vibration membrane to a diameter of the cavity is 70% to 90%, and the angle θ1 is between about 5° to 50°.

6. The micro speaker of claim 5, wherein the ratio of the diameter of the first portion of the first vibration diaphragm to the diameter of the cavity is 70% to 80%, and the angle θ1 is between about 20° to 50°.

7. The micro speaker of claim 4, wherein:

the first end portion of the first lead wire and the first end portion of the second lead wire each extend in a straight line along the first imaginary straight line, and the second end portion of the first lead wire and the second end portion of the second lead wire each extend in a straight line along the second imaginary straight line.

8. The micro speaker of claim 7, wherein:

the first end portions of the first and second lead wires each protrude a distance Lb over the cavity;

the second end portions of the first and second lead wires each protrude a distance La over the cavity;

a width of each of the first and second lead wires is W;

$L_b$ is between about 1W and 1.5W; and $L_a$ is between about 1W and 1.5 W.

9. The micro speaker of claim 1, wherein the first vibration membrane further comprises support portions supporting the first and second lead wires and disposed in the second area, wherein the support portions have the same shape as that of the first and second lead wires.

10. The micro speaker of claim 1, wherein an elastic coefficient of the second vibration membrane is lower than an elastic coefficient of the first vibration membrane.

11. The micro speaker of claim 10, wherein the second vibration membrane is formed of a polymer thin film.

12. The micro speaker of claim 1, wherein the first vibration membrane comprises a first portion disposed in the first area and a second portion disposed on the substrate; and the second vibration membrane is disposed in the second area, at least an edge portion of an upper surface of the piezoelectric actuator, and an upper surface of the second portion of the first vibration membrane.

* * * * *